US009834957B2

(12) United States Patent
Campbell et al.

(10) Patent No.: US 9,834,957 B2
(45) **Date of Patent: *Dec. 5, 2017**

(54) TILT LATCH FOR WINDOW

(71) Applicant: PLY GEM INDUSTRIES, INC., Cary, NC (US)

(72) Inventors: Colin David Campbell, Daleville, VA (US); Kenton Sites Gibbs, Jr., Rocky Mount, VA (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/294,316

(22) Filed: Oct. 14, 2016

(65) Prior Publication Data

US 2017/0030108 A1 Feb. 2, 2017

Related U.S. Application Data

(63) Continuation of application No. 14/142,585, filed on Dec. 27, 2013, now Pat. No. 9,493,970.

(60) Provisional application No. 61/476,222, filed on Dec. 27, 2012.

(51) Int. Cl.

| | |
|---|---|
| ***E05B 17/20*** | (2006.01) |
| ***E05C 1/10*** | (2006.01) |
| ***E05B 17/00*** | (2006.01) |
| ***E05B 63/12*** | (2006.01) |

(52) U.S. Cl.

CPC ..... *E05B 17/2007* (2013.01); *E05B 17/0062* (2013.01); *E05B 63/12* (2013.01); *E05C 1/10* (2013.01); *Y10T 292/097* (2015.04)

(58) Field of Classification Search

CPC ..... E05C 1/10; E05B 17/0062; Y10T 292/097

See application file for complete search history.

(56) References Cited

U.S. PATENT DOCUMENTS

| | | | | |
|---|---|---|---|---|
| 913,409 | A * | 2/1909 | Marbach | E05B 15/10 292/156 |
| 5,165,737 | A * | 11/1992 | Riegelman | E05B 63/14 292/175 |
| 5,618,067 | A * | 4/1997 | Carlson | E05B 9/08 292/175 |
| 8,220,846 | B2 * | 7/2012 | Liang | E05B 63/12 292/163 |
| 8,336,927 | B2 * | 12/2012 | Liang | E05B 9/08 292/163 |
| 2004/0074146 | A1 * | 4/2004 | Eenigenburg | E05B 65/087 49/183 |
| 2007/0157521 | A1 * | 7/2007 | Ito | E06B 3/5063 49/185 |

(Continued)

*Primary Examiner* — Gregory Strimbu
(74) *Attorney, Agent, or Firm* — Lathrop Gage L.L.P.

(57) ABSTRACT

A sash latch for engagement with a side jamb of a window includes an upper member with a spring cavity and a stop wall, a forward slot for engagement with an upper surface of a sash and a latch extension. The latch extension includes a substantially planar surface and an inclined planar surface extending at an acute angle relative to the substantially planar surface. The inclined planar surface includes a notch at a proximal end thereof, wherein the notch receives an edge of a wall of the side jamb when a heavy wind load is applied to an outer facing surface of the sash to restrain the sash relative to the side jamb.

4 Claims, 3 Drawing Sheets

(56) References Cited

U.S. PATENT DOCUMENTS

| | | | | |
|---|---|---|---|---|
| 2009/0223130 | A2* | 9/2009 | Ozawa | E05D 15/22 49/185 |
| 2010/0037524 | A1* | 2/2010 | Liang | E05B 63/12 49/176 |
| 2013/0093198 | A1* | 4/2013 | Liang | E05C 1/10 292/163 |

* cited by examiner

TILT LATCH FOR WINDOW

RELATED APPLICATIONS

This application claims the benefit of priority to U.S. Provisional Application No. 61/746,222 filed on Dec. 27, 2012 and U.S. application Ser. No. 14/142,585, now U.S. Pat. No. 9,493,970, filed on Dec. 27, 2013.

TECHNICAL FIELD

The present disclosure relates to a sash latch for engagement with a side jamb of a window.

BACKGROUND

During inclement or windy weather, it can be dangerous to open a window. The force of the wind against the exterior of a window can cause the window sash to fly inward due to structural failure of the window. A pressure differential between the inside and outside of a structure can also cause a window sash to move unexpectedly and with great force. In most situations, tilt latches will remain extended, keeping the sash in place. But under some extreme conditions, the various window components deform to a degree that the tilt latches retract, putting higher stresses on the other window hardware which can lead to further failures and the sash is free to swing inward, causing damage or death.

It would be beneficial to automatically prevent a window from tilting during inclement, windy, or pressure differential conditions that might present a danger of a sudden, forceful window failure or movement. An automatic lock would prevent the window from tilting inward under such conditions.

SUMMARY

A deformable tilt latch contains a slot to receive a pillar. When the pillar is received by the slot, the latch cannot be retracted or moved so as to allow the window to be tilted inward from the window frame. The tilt latch is made of a deformable material. The deformable material deforms when a pressure or force is applied to the exterior of the window. When the deformable tilt latch deforms, the pillar is received in the slot, preventing the latch from operating and, thus, preventing the window from being suddenly or forcefully tilted inward by forces of nature.

DETAILED DESCRIPTION

Figure 1A:
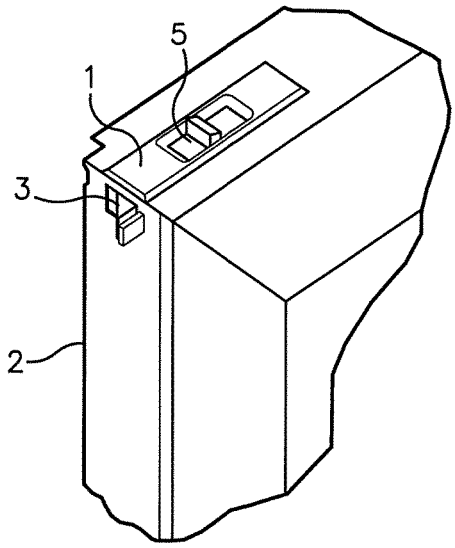
FIG. 1A is a perspective view of a tilt latch of an embodiment of a latch installed within a corner of a window sash.
Figure 1B:
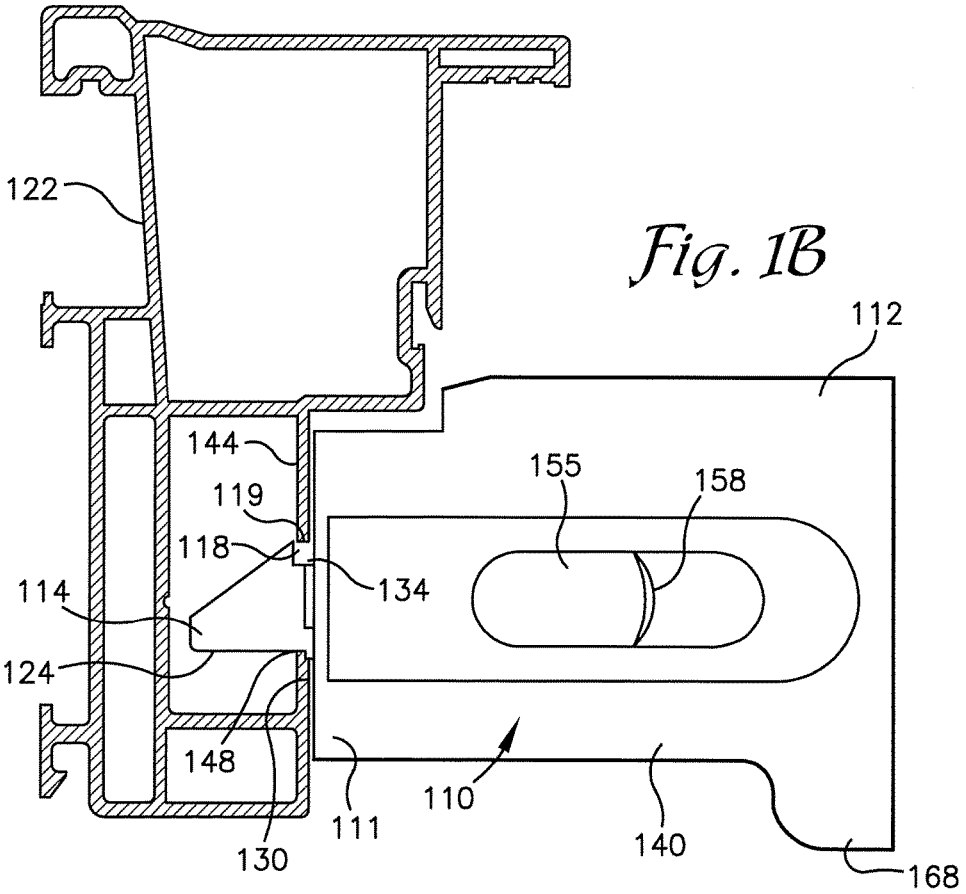
FIG. 1B is a cross sectional view of an alternative embodiment of a latch installed atop the window sash and detailing interaction with the window frame.

FIG. 1A illustrates a first embodiment of a latch 1 installed into a corner of a window sash 2. Protruding outwardly from the latch 1 is an extension 3 that extends into an opening of a window frame or side jamb (not shown) to prevent the window sash 2 from inadvertently opening/tilting into the interior of the building. FIG. 1B is an alternative embodiment of the latch 1 illustrated in FIG. 1A. As with the first embodiment, the alternative embodiment latch 110 is disposed within a top corner 111 of a window sash 112 with a latch extension 114 shown positioned within an opening 118 of a window frame 122 shown in a cross sectional view. The latch extension 114 includes a generally planar edge 124 with serrations 126 that when inserted into the opening 118 in the window frame 122 engage a wall member 130 of the window frame 122. FIG. 1B further illustrates a notch 134 within the extension 114 on the side opposite the serrations 126.

When under a heavy wind load the sash extension 114 can exert tremendous pressure on the frame 122. At times, the force applied by very strong winds may cause the upper sash member 140 to flex to such a degree that the center of the sash 140 moves slightly toward the interior of the building causing the outer ends of the upper sash member 140, constrained by the window frame 122, to rotate ever so slightly causing the notch 134 to receive the outwardly extending flange members 144 that comprise an edge of the opening 118. Once the flange member 144 is engaged within the notch 134 it is far less likely that the slightly rotated latch extension 114 can slide past the edge 148 of the opening 118. The notch 134 and flange member 144 combination serves as a second mechanism, in combination with the serrated edges 126 on the extension 114, to prevent the inadvertent rotation/opening of the window under high wind load conditions. The very edge 119 of flange member 144 is in close proximity to the notch 134 so that when the flexure of the sash does occur the edge 119 is received into the notch 134 thereby preventing opening of the window. The extension 114 is able to pass through the opening 118 without interference with the edge 119 and contact between the notch 134 and edge 119 only occurs under heavy load conditions.

Figure 2A:
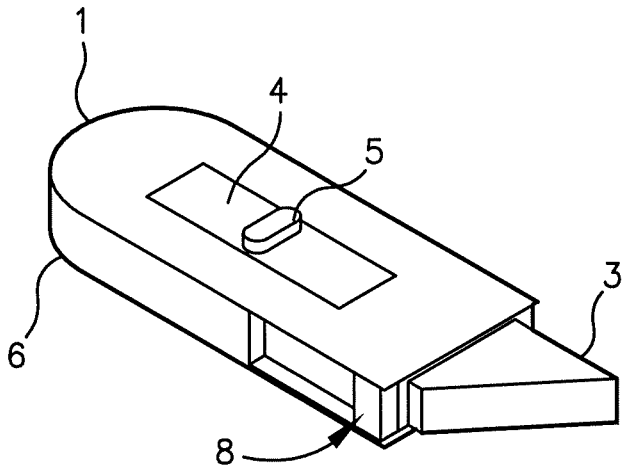
FIG. 2A is a larger perspective view of the embodiment of the latch shown in FIG. 1A.
Figure 2B:
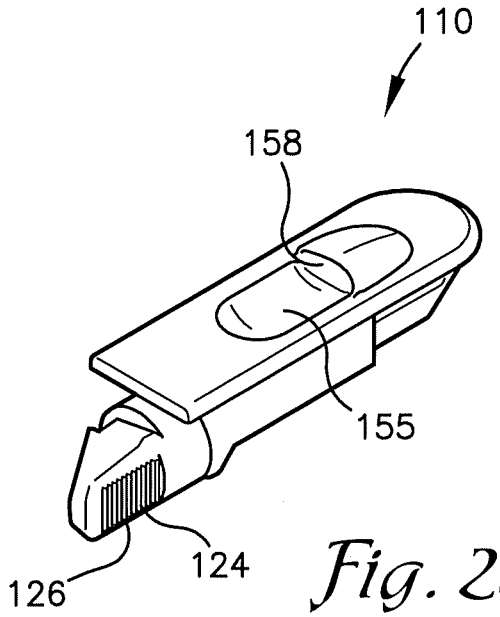
FIG. 2B is a perspective view of the embodiment of the latch shown in FIG. 1B.

As shown in FIG. 2A the first embodiment of the latch 1 contains a movable slide 4 that slidably extends and retracts so as to move the extension 3 of the slide 4 into an opening in a window frame (not shown) and into and out of engagement with a side of, or other fixed member in, the opening in the window frame. When the extension 3 is extended into the window frame, the sash 2 is thus fixed in the window frame and cannot be tilted inward. When the extension 3 is retracted out of the frame, the sash 2 may be tilted inward for cleaning, removal, or other maintenance.

The latch, as shown in FIG. 2A has a finger grip 5 to allow a user to move the slide 4 so that the extension 3 of the slide 4 may be moved into and out of engagement with the window frame. When the user uses the finger grip 5 to move the slide 4 so that the extension 3 is out of engagement with the frame, the window sash 2 may be moved within the window frame. When the slide 4 is moved into engagement with the frame, the window sash is immobilized. The latch further reveals a pillar 8 that serves to limit the flexure of the extension 3 when the latch is placed under a heavy load such as during a strong wind event. The pillar 8 serves to limit the deformation of the latch 1 and particularly the extension 3.

As further shown in FIG. 2A, the slide 4 is movable within a housing 6. The sash 2, slide 4 and housing 6 are made of materials such as nylon, vinyl, aluminum, or plastic that deforms slightly when a pressure or other force is applied to an exterior face of the sash 2.

Figure 3:
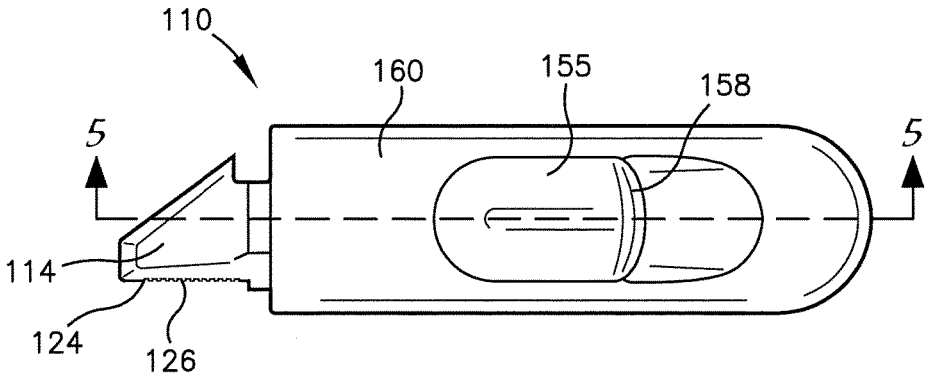
FIG. 3 is a plan view of the embodiment of the latch illustrated in FIG. 2B.
Figure 4:
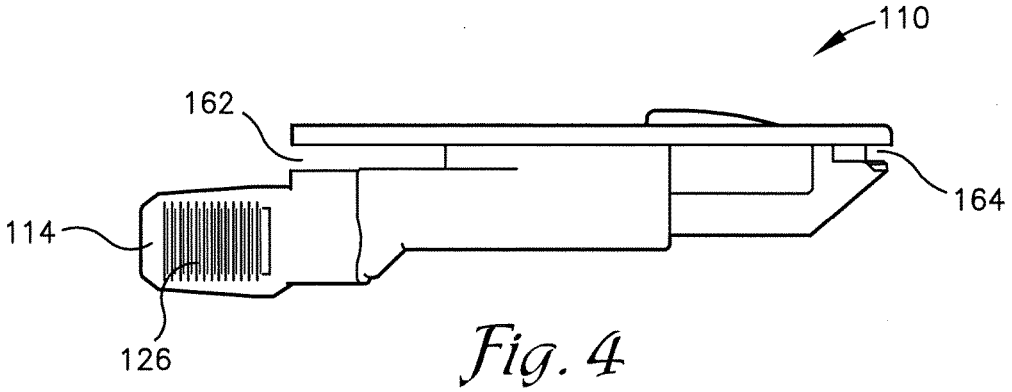
FIG. 4 is an elevation view of the embodiment of the latch illustrated in FIG. 2B.

FIG. 3 illustrates the thumb depression 155 and thumb backstop 158 disposed within and atop the upper surface 160 of the latch 110. FIG. 3 further illustrates the extension 114 with the serrations 126 that engage the opening 118 of the frame. FIG. 4 illustrates the two piece construction of the latch 110 with forward 162 and rear 164 slots for engagement with the upper surface 168 of the sash when the latch 110 is installed therein.

Figure 5:
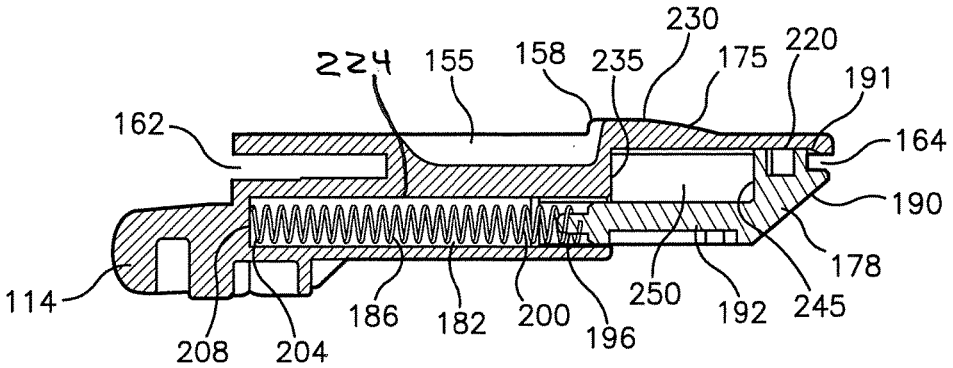
FIG. 5 is a cross sectional view of FIG. 3 taken along line 5-5 detailing the two piece assembly.

FIG. 5 further illustrates the two piece construction of the latch. Specifically, the latch 110 includes an upper member 175 and a lower member 178. The upper member includes the thumb depression and thumb backstop 158, the extension 114 and a spring cavity 182 for retaining the spring 186. The lower member 178 includes the rear support element 190 with an upper surface 191 in contact with the upper member 175 and a plunger arm 192 with an engagement member 196 for engagement with the spring 186 that is housed within the spring cavity 182. The plunger arm 192 extends slightly into the spring cavity 182 and the first end 200 of the coiled spring 186 wraps around an engagement nub 196 and the second end 204 of the spring 186 is positioned against the stop wall 208 of the spring cavity 182. The upper and lower members 175, 178 are effectively integrated with one another.

In operation, when the latch is installed in the sash, the user will place their thumb in the thumb depression 155 and push against the thumb backstop 158. The latch will resist movement backward because the sash upper surface 168 will be inserted into the forward and rear slots 162, 164 which respectively restrict movement of the upper and lower members 175, 178 to a preset distance. The user will push back on the thumb stop 158 which will cause the upper member 175 to move backward with the thumb pressure and to be resisted by the spring 186 that will be applying a counter pressure against the stop wall 208. The upper member 175 will slide past the lower member 178 at surface 220 and at the spring cavity surface 224 where the arm 192 slides into the spring cavity 182.

As the thumb pressure increases the spring 186 will be further compressed within the spring cavity 182 until the extension 114 is fully retracted from the opening 118 of the window frame 122. Once fully retracted from the opening 118, the sash may be rotated to the desired position and the user may release thumb pressure which will cause the spring to expand to its original position within the spring cavity 182 under no load. The upper member 175 is capable of sliding over the lower member 178 for a predetermined distance because the upper member 175 is fabricated with an overhang portion 230 that eliminates any interference between the upper and lower members as they slide past one another at surface 220 and within the spring cavity 182. The upper member 175 may slide over the lower member 178 until the upper member vertical wall 235 encounters the vertical wall 245 of the lower member 178. When the spring 186 is fully expanded a cavity 250 is formed between the upper and lower members 175, 178 that is completely closed when the extension 114 is fully retracted from the opening in the jamb 118.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

The invention claimed is:

1. A sash latch for engagement with a side jamb of a window, the sash latch comprising:

an upper member having an upper surface, a spring cavity with a stop wall, a forward slot for engagement with an upper surface of a sash of the window, and a latch extension, the latch extension comprising a substantially planar surface extending generally parallel to a longitudinal axis of said upper member and an inclined planar surface oppositely disposed from and at an acute angle to the substantially planar surface, a notch disposed within the inclined planar surface at a proximal end of the inclined planar surface, wherein the notch opens in a direction extending generally perpendicularly away from the substantially planar surface, wherein the latch extension is retractably receivable in an opening in the side jamb of the window to restrain the sash relative to the side jamb, when the latch extension is received in the opening in the side jamb, the notch is configured for receiving an edge of a wall of the side jamb when a force is applied to an exterior facing surface of the sash thereby restraining the sash relative to the side jamb;

a lower member having a support member and a plunger arm extending outwardly from the support member, the plunger arm including an engagement nub at a distal end of the plunger arm; and a spring disposed in the spring cavity, a first end of the spring contacts the stop wall, a second end of the spring engages the engagement nub of the plunger arm;

wherein to retract the latch extension from the opening in the side jamb, the upper member is moved away from the side jamb causing the upper member to slide over the lower member and to retract the latch extension from the opening in the side jamb.

2. The sash latch of claim 1, wherein the upper member is fabricated from a polymer.

3. The sash latch of claim 1, wherein the lower member is fabricated from a polymer.

4. A sash latch for engagement with a side jamb of a window, the sash latch comprising:

an upper member having an upper surface and a lower surface, the upper member having a distal end and a proximal end and a spring cavity, the spring cavity including a stop wall at one end thereof, a slot proximate the proximal end of the upper member for engagement with an upper surface of a sash of the window, a latch extension with a substantially planar surface extending generally parallel to a longitudinal axis of said upper member and an inclined planar surface disposed opposite said substantially planar surface and at an acute angle to the substantially planar surface, the inclined planar surface having a proximal end nearer the spring cavity than a distal end of the latch extension, a notch disposed within the proximal end of the inclined planar surface, extending into the inclined planar surface and extending perpendicular to the substantially planar surface, wherein the latch extension is retractably received into an opening in the side jamb of the window to restrain the sash relative to the side jamb when the latch extension is received in the opening in the side jamb, and an edge of a wall of the side jamb of the window is received into the notch when a force is applied to an exterior facing surface of the sash thereby restraining the sash relative to the side jamb;

a lower member, the lower member having an upper surface for slidable engagement with the lower surface of the upper member and a plunger arm extending outwardly from a support member, the plunger arm including an engagement nub at a distal end of the plunger arm; and a spring disposed in the spring cavity, a first end of the spring contacts with the stop wall, a second end of the spring engages with the engagement nub of the plunger arm;

wherein to retract the latch extension from the opening in the side jamb, the upper member is moved away from the side jamb causing the upper member to slide over the lower member and to retract the latch extension from the opening in the side jamb.

* * * * *